US007255603B2

(12) United States Patent
Kato et al.

(10) Patent No.: US 7,255,603 B2
(45) Date of Patent: Aug. 14, 2007

(54) MEMORY CARD CONNECTOR

(75) Inventors: Masato Kato, Kanagawa (JP); Hiroshi Fukuzaki, Kanagawa (JP); Tsuyoshi Fukami, Kanagawa (JP); Yoichi Kasamaru, Kanagawa (JP); Masaharu Takai, Kanagawa (JP)

(73) Assignee: J.S.T. Mfg. Co., Ltd., Tokyo (JP)

( * ) Notice: Subject to any disclaimer, the term of this patent is extended or adjusted under 35 U.S.C. 154(b) by 0 days.

(21) Appl. No.: 11/000,031

(22) Filed: Dec. 1, 2004

(65) Prior Publication Data

US 2005/0136744 A1 Jun. 23, 2005

(30) Foreign Application Priority Data

Dec. 1, 2003 (JP) ..... 2003-402295

(51) Int. Cl.
*H01R 24/00* (2006.01)

(52) U.S. Cl. ..... 439/630

(58) Field of Classification Search ..... 439/630, 439/325, 329

See application file for complete search history.

(56) References Cited

FOREIGN PATENT DOCUMENTS

| | | | |
|---|---|---|---|
| JP | 2001-135385 | A | 5/2001 |
| JP | 2001-135387 | A | 5/2001 |
| JP | 2001-143789 | A | 5/2001 |
| JP | 2001-143816 | A | 5/2001 |
| JP | 2001-160458 | A | 6/2001 |
| JP | 2001-167232 | A | 6/2001 |
| JP | 2001-223044 | A | 8/2001 |
| JP | 2001-313107 | A | 11/2001 |
| JP | 2001-313128 | A | 11/2001 |
| JP | 2002-007972 | A | 1/2002 |
| JP | 2002-134234 | A | 5/2002 |
| JP | 2002-237351 | A | 8/2002 |
| JP | 2002-270287 | A | 9/2002 |

*Primary Examiner*—Briggitte R. Hammond
(74) *Attorney, Agent, or Firm*—Rader, Fishman & Grauer PLLC

(57) ABSTRACT

A connector used for a plurality (plural kinds) of memory cards is provided in which contacts can easily be assembled and contact leads can rapidly be inspected visually. A housing 4 is covered with a cover 3 so that a card holding part 42 is formed that has a card insertion port 41 shared by an SD card 1 and a Memory Stick card 2. The SD card 1 stops at a position near the card insertion port 41, while the Memory Stick card 2 stops at a position distant from the card insertion port 41. Cantilever contacts 5 have first contact points 51 for contacting with surface contact terminal 1A, while first lead parts 52 extend out from a stopper 43. Cantilever contacts 6 have second contact points 61 for contacting with surface contact terminal 2A, while second lead parts 62 extend out from the stopper 43. A plurality of the first lead parts 52 and a plurality of the second lead parts 62 extend out in parallel to each other from the stopper 43.

10 Claims, 9 Drawing Sheets

MEMORY CARD CONNECTOR

CROSS-REFERENCE TO RELATED APPLICATIONS

This application is based upon and claims the benefits of priorities from Japanese Patent Application No. 2003-402295 filed on Dec. 1, 2003, the entire contents of which are incorporated herein by reference, This application is related to co-pending U.S. patent applications entitled "Connector" and "Connector and Connector Groove," and being filed on even date herewith. The co-pending applications are expressly incorporated herein by reference.

FIELD OF THE INVENTION

The present invention relates to a connector for memory cards. In particular, it relates to a sharing type connector for at least two kinds of memory cards being commonly provided with surface contact terminals in leading end portions thereof but having different lengths in the direction of insertion, the connector being commonly utilized for the connection with either memory card to be inserted.

RELATED ART

Memory cards serving as card type storage devices use flesh memories as their storage media. Such memory cards are remarkably small, and consume hardly any electric power in reading and writing of data. Thus, memory cards have spread widely as recording media for portable information devices such as a portable telephone and a PDA (Personal Digital Assistance).

In comparison with disk type storage devices such as a flexible disk (FD) and a magneto-optical disc (MO), memory cards had only a small storage capacity and were expensive in the past. However, technological progress in recent years together with the effects of mass production caused by the spread of devices using memory cards has realized memory cards having large storage capacities up to 128 MB or the like at low prices.

Further, memory cards have an advantage that no drive is necessary in reading and writing of data in contrast to the case of FDs and MOs. Thus, memory cards are suitable for digital cameras, notebook type personal computers, and portable music players in which their power consumption and portability are important.

Such memory cards presently used for recording include an SD (Secure Digital) card, a Memory Stick card, SmartMedia, and an MMC (Multimedia Card). Further, an example of memory cards for information management is a SIM (Subscriber Identify Module) card which serves as an IC card built in a portable telephone.

In such situations, a composite type connector for memory cards is desired that can simultaneously load these plural kinds of memory cards having different shapes or surface contact terminal configurations from each other. Further, a sharing type connector for a memory card is desired that can load any one of such plural kinds of memory cards.

As an example of the above-mentioned composite type connector, a connector for memory cards has been invented which can house a Memory Stick card and SmartMedia having different outer shapes and surface contact terminal configurations from each other, and in which a connector housing is constructed such that a first slot for housing the Memory Stick card and a second slot for housing the SmartMedia are arranged one above the other (e.g., Japanese Published Unexamined Patent Publication No. 2001-313107).

In the connector for memory cards according to Japanese Published Unexamined Patent Publication No. 2001-313107, a plurality of first contact terminals for contacting with the Memory Stick card are arranged such that the solder-bonded parts thereof are located on one side of the front side and the rear side. While a plurality of second contact terminald for contacting with the SmartMedia are arranged such that the solder-bonded parts thereof are located on the other side of the front side and the rear side. That is, the second contact terminal are arranged in the reverse direction to the first contact terminal.

The connector for memory cards according to Japanese Published Unexamined Patent Publication No. 2001-313107 is described such as to have the advantages of reducing the area occupied by the connector on a printed circuit board, and of simplifying layout work, soldering work, and repair work for the contact terminal.

As another example of the above-mentioned composite type connector, a connector for memory cards has been invented which holds an MMC and a SIM card within a connector housing in such a manner that surface contact terminal of the cards abut against contact terminal arranged within the connector housing, and in which a first card housing part provided with contact terminal for an MMC and thereby housing the MMC and a second card housing part provided with contact terminal for a SIM card and thereby housing the SIM card are arranged one above the other (e.g., Japanese Published Unexamined Patent Publication No, 2002-134234).

In the connector for memory cards according to Japanese Published Unexamined Patent Publication No. 2002-134234, the connector housing is constructed such that the contact terminal for an MMC are arranged approximately perpendicular to the contact terminal for a SIM card. Further, the first card housing part for housing the MMC having a larger outer size than the SIM card is arranged on the bottom side of the connector housing, while the second card housing part for housing the SIM card is arranged on the top side of the connector housing.

The connector for memory cards according to Japanese Published Unexamined Patent Publication No. 2002-134234 is described such that the sharing type connector has an advantage in the thickness reduction of the connector housing.

FIG. 8 is a plan view showing the arrangement of the contact terminals for both memory cards according to the invention of Japanese Published Unexamined Patent Publication No. 2001-313107. FIG. 8 of the present specification corresponds to FIG. 9 of Japanese Published Unexamined Patent Publication No. 2001-313107.

In FIG. 8, with regard to a plurality of the first contact terminals 81 for contacting with the Memory Stick card, solder-bonded parts 81A of the first contact terminal 81 extend from the front side of the connector housing. In contrast, with regard to the plurality of second contact terminals 82 for contacting with the SmartMedia, solder-bonded parts 82A of the second contact terminal 82 extend from the rear side of the connector housing.

In FIG. 8, the first contact terminals 81 are pressed into the connector housing from the front side toward the rear side. The second contact terminals 82 are pressed into the connector housing from the rear side toward the front side.

Being narrow and soft, the solder-bonded parts 81A and 82A serving as leads shown in FIG. 8 can handle any lead bends that occur. In the assembly of the leads into the connector housing, in a case where a bent lead occurs in the solder-bonded parts 81A and 82A extending from the connector housing, the solder-bonded parts 81A and 82A cannot be soldered correctly to pads or edge connectors formed on the printed circuit board.

In order to avoid such poor soldering, in the assembled connector for memory cards, the soldering junction 81A group and the soldering junction 82A group are taken as images with a CCD camera or the like, so that a bent lead is detected by the image recognition.

Nevertheless, in the connector for memory cards shown in FIG. 8, the soldering junction 81A group and the soldering junction 82A group are apart from each other in opposite directions, This prevents simultaneous image acquisition of these groups by means of a CCD camera, and requires two separate image acquisition operations. This causes an issue of an increase in the inspection time. The increase in the inspection time raises the cost per connector for a memory cards, especially in the case of total inspection.

Further, in the connector for memory cards shown in FIG. 8, the first contact terminals 81 and the second contact terminals 82 are pressed oppositely into the connector housing. This causes an issue of poor workability in assembly. Thus, a connector for memory cards is desired that has a structure such that two kinds of contact terminal are pushed into a connector housing from the same direction.

FIG. 9 is a perspective view showing an embodiment of a connector for memory cards according to the invention of Japanese Published Unexamined Patent Publication No. 2002-134234 illustrated in a state where an opening/closing cover is opened. FIG. 9 of the present specification corresponds to FIG. 1 of Japanese Published Unexamined Patent Publication No. 2002-134234.

In FIG. 9, the first card housing part 91 for housing an MMC is formed on the lower stage of the connector housing 90. The second card housing part 92 for housing a SIM card is formed on the upper stage of the connector housing 90.

In FIG. 9, an MMC is inserted into the first card housing part 91 in the direction indicated by an arrow A in the figure. The solder-bonded parts 93A of the contact terminal (not shown) for an MMC extend out on the side opposite to the insertion opening of the first card housing part 91.

On the other hand, in FIG. 9, a SIM card is loaded to the second card housing part 92. In the bottom surface of the second card housing part 92, two kinds (long and short) of contact terminal 94 are arranged such that these contact points are opposite each other. The contact terminal 94 for a SIM card extend out from the connector housing 90 in a manner conflicting with the solder-bonded parts 94A.

In FIG. 9, when the opening/closing cover 95 is closed and covers the second card housing part 92, a SIM card contacts with a plurality of contact terminals 94. At that time, the opening/closing cover 95 can be locked into the connector housing 90.

In FIG. 9, in the assembled connector for a memory cards, the soldering junction 93A group and the soldering junction 94A group arranged in a conflicting manner are image-acquired with a CCD camera or the like, so that the presence or absence of a lead bend is image-recognized. In the configuration of FIG. 9, the soldering junction 93A group and the soldering junction 94A group cannot simultaneously be image-acquired with a CCD camera. More specifically, three image acquisition operations are necessary, This causes an issue of an increase in the inspection time.

Further, in the connector for memory cards shown in FIG. 9, the insertion directions differ for the MMC and for the SIM card. When such a connector for memory cards is built in an electronic device, its chassis design is constrained by restrictions. Thus, a connector for memory cards is desired in which two kinds of memory cards are inserted in the same direction and hence a higher degree of freedom is obtained.

SUMMARY OF THE INVENTION

In order to solve the above-mentioned issues, an object of the present invention is to provide a connector for memory cards capable of being shared by a plurality of memory cards, wherein contacts can easily be assembled and contact leads can be rapidly inspected visually.

In order to achieve the above-mentioned object, the present inventors have adopted a structure that two kinds of contacts are attached to a housing from the same direction. As a result of this approach, a new connector for memory cards has been invented as follows.

(1) A sharing type connector for at least two kinds of memory cards being provided with surface contact terminals in leading end portions thereof and having different lengths in the insertion direction, either memory card being inserted and thereby being electrically connected, the connector comprising:

a housing being provided with a card holding part having a housing space of an approximately thin rectangular parallelepiped shape being defined by covering with a cover and a card insertion port through which either of the two kinds of memory cards are inserted, wherein a short memory card of the two kinds of memory cards is held such that the surface contact terminals of the short memory card are stopped at a near position from the card insertion port while a long memory card of the two memory cards is held such that the surface contact terminals of the long memory card is stopped at a far position from said card insertion port;

a plurality of first cantilever contacts having first contact points for contacting with the surface contact terminals of the short memory card, wherein the first contact points of the plurality of first cantilever contacts are arranged in the card holding part, and wherein first lead parts to be soldered, while having the first contact points to opposite end portions thereof, extend outside from a stopper opposite to the card insertion port; and a plurality of second cantilever contacts having second contact points for contacting with the surface contact terminals of the long memory card, wherein the second contact points are arranged in the card holding part, and wherein second lead parts to be soldered, while having the second contact points to opposite end portions thereof, extend outside from the stopper opposite to the card insertion port;

wherein a group of the plurality of first cantilever contacts and a group of the plurality of second cantilever contacts are arranged in parallel to each other in the housing.

(2) The connector according to (1), wherein the plurality of first lead parts and the plurality of second lead parts extend outside in parallel from the stopper.

(3) The connector according to (1) or (2), wherein the plurality of first lead parts and the plurality of second lead parts are arranged oppositely with a predetermined space.

(4) The connector according to any one from (1) to (3), wherein a pair of grooves for guiding opposing side surfaces of the short memory card being inserted through the card insertion port are formed in mutually opposing inner walls of the card holding part, and wherein a stopping edge is provided to each of the grooves so as to stop the surface contact terminals of the short memory card at a near position from the card insertion port.

(5) The connector according to any one from (1) to (4), wherein:

a plurality of first rectangular grooves for holding first fixing parts in a vicinity of first free end parts having the first contact points are formed in a bottom surface of the card holding part;

a plurality of second rectangular grooves for holding second fixing parts in a vicinity of the first lead parts are formed in the bottom surface of the housing opposite the bottom surface of said card holding part;

through holes being disposed between the plurality of first rectangular grooves and the plurality of second rectangular grooves are formed in the bottom surface of the card holding part; and the first free end parts of the first cantilever contacts are inserted into the through holes; and the first fixing part and the second fixing part are pressed into the first rectangular grooves and the second rectangular grooves, respectively, as the first cantilever contacts are turned around the through holes.

(6) The connector according to any one from (1) to (5), wherein:

the mutually opposing side surfaces of the long memory card inserted through the card insertion port are guided by a pair of mutually opposing inner walls of the card holding part, and wherein the long memory card abuts on the stopper so that the surface contact terminals of the long memory card are stopped at a far position from the card insertion port.

(7) The connector according to any one from (1) to (6), wherein:

a plurality of rectangular holes for holding third fixing parts continuing toward second free end parts having the second contact points are formed in the stopper;

the plurality of rectangular holes pass through toward the card insertion port;

the second free end parts of the first cantilever contacts are inserted through the card insertion port into the rectangular holes; and the third fixing parts are pressed into the rectangular holes.

(8) The connector according to any one from (1) to (5), wherein the short memory card includes an SD (Secure Digital) card.

(9) The connector according to any one of (1) to (3) and (6) or (7), wherein the long memory card includes a Memory Stick card.

The invention according to (1) is characterized by a sharing type connector for a memory card to which either of two kinds of memory cards each provided with surface contact terminals in an end part and at least having a length different from that of the other card in the insertion direction is inserted and thereby electrically connected, the connector comprising: a housing provided with a card holding part having the shape of an approximately thin rectangular parallelepiped and having a housing space having a card insertion port to which said two kinds of memory cards are inserted in common when covered with a cover, wherein the short one of said memory cards is held such that said surface contact terminal stop at a position near said card insertion port, while the long one of said memory cards is held such that said surface contact terminal stop at a position distant from said card insertion port; a plurality of first cantilever contacts having first contact points for contacting with the surface contact terminal of said short memory card, wherein said first contact points are arranged in said card holding part, and wherein first lead parts to be soldered opposite said first contact points extend out from a stopper opposite said card insertion port; and a plurality of second cantilever contacts having second contact points for contacting with the surface contact terminal of said long memory card, wherein said second contact points are arranged in said card holding part, and wherein second lead parts to be soldered opposite said second contact points extend out from a stopper opposite said card insertion port; wherein a plurality of said first cantilever contacts and a plurality of said second cantilever contacts are arranged in parallel to each other in said housing.

Each of the two kinds of memory cards each provided with surface contact terminal in an end part and at least having a length different from that of the other card in the insertion direction is formed in the shape of a card fabricated by sealing an IC chip into a card shaped capsule. The short memory card may be a storage device in which a first surface contact terminal group is arranged on the bottom surface of an insertion end part, while the long memory card may be a storage device in which a second surface contact terminal group is arranged on the bottom surface of an insertion end part In a preferred embodiment of the present invention, the short memory card inserted into or extracted from the connector for memory cards may include an SD card, while the long memory card inserted into or extracted from the connector for memory cards may include a Memory Stick card.

The outer dimensions of the SD card are 24 mm×32 mm×1.4 mm, and the outer dimensions of the Memory Stick card are 21.5 mm×50 mm×2.8 mm. The lengths of the insertion direction of the SD card and the Memory Stick card differ by 18 mm.

The housing may be formed of an insulating synthetic resin material. In a preferred embodiment of the present invention, the housing may be formed in the shape of an approximately thin rectangular parallelepiped having a size sufficient for housing the short memory card and the long memory card in common.

An upper surface opening recess is formed in the housing. A cover formed by folding at right angles two wings of a thin metal plate covers the upper surface opening recess. As a result, a card holding part is formed that has the shape of an approximately thin rectangular parallelepiped and has a housing space having a card insertion port to which said two kinds of memory cards are inserted in common.

In the first and the second cantilever contacts, the function of a spring provides a cantilever contact. A plurality of the first and the second cantilever contacts are aligned such as to contact with the first and the second surface contact terminal formed on the short and the long memory cards.

The fixing parts of the first and the second cantilever contacts are held in the housing by press fit or the like. Further, the distal ends of the fixing parts are formed as the first and the second lead parts to be soldered to a printed circuit board on which this connector for a memory card is mounted. That is, these distal ends have the function of holding the housing on the printed circuit board.

The invention according to (2) is characterized by a connector for memory cards wherein a plurality of said first lead parts and a plurality of said second lead parts extend out in parallel from said stopper.

The invention according to (3) is characterized by a connector for memory cards wherein a plurality of said first lead parts and a plurality of said second lead parts are arranged oppositely with a predetermined spacing.

The connector for a memory card according to the present invention may be a so-called straddle mount type connector in which lead parts of contacts extending out in the rear part of a housing clamp a printed circuit board, and in which said lead parts are soldered and connected electrically to the printed circuit board.

Such a straddle mount type connector for printed circuit boards allows height reduction, that is, a reduction of the height of the mounting. Further, this connector allows narrow pitch contacts to be soldered on a printed circuit board.

In such a connector for memory cards in which a plurality of first lead parts and a plurality of second lead parts extend out in parallel with a predetermined spacing in the rear part of the housing, the first lead part group and the second lead part group can simultaneously be image-acquired with a CCD camera. This reduces the time necessary for inspecting the presence or absence of a lead bend.

In a preferred embodiment of the present invention is characterized by a connector for a memory card wherein a pair of grooves for guiding the mutually opposing side surfaces of said short memory card inserted through said card insertion port are formed in a pair of mutually opposing inner walls of said card holding part, and wherein a stopping edge is provided in each of a pair of said grooves so as to stop the surface contact terminal of said short memory card at a position near said card insertion port.

In a preferred embodiment of the present invention is characterized by a connector for memory cards wherein the mutually opposing side surfaces of said long memory card inserted through said card insertion port are guided by a pair of mutually opposing inner walls of said card holding part, and wherein said long memory card abuts against said stopper so that the surface contact terminal of said long memory card stop at a position distant from said card insertion port.

As such, in the connector for memory cards according to the present invention, a short memory card (such as an SD card) and a long memory card (such as a Memory Stick card) can be inserted or extracted in the same direction. This ensures a degree of freedom in the design of an electronic device into which the connector for memory cards according to the present invention is built.

In a preferred embodiment of the present invention is characterized by a connector for memory cards wherein: a plurality of first rectangular grooves for holding first fixing parts in the vicinity of first free end parts having said first contact points are formed in the bottom surface of said card holding part; a plurality of second rectangular grooves for holding second fixing parts in the vicinity of said first lead parts are formed in the bottom surface of said housing opposite the bottom surface of said card holding part; through holes for isolating a plurality of said first rectangular grooves from a plurality of said second rectangular grooves are formed in the bottom surface of said card holding part; and the first free end parts of said first cantilever contacts are inserted into said through holes; said first fixing part and said second fixing part are cooperatively pressed into said first rectangular grooves and said second rectangular grooves.

In a preferred embodiment of the present invention is characterized by a connector for memory cards wherein: a plurality of rectangular holes for holding third fixing parts continuing to second free end parts having said second contact points are formed in said stopper; a plurality of said rectangular holes pass through toward said card insertion port; the second free end parts of said first cantilever contacts are inserted toward said card insertion port into said rectangular holes; and said third fixing parts are pressed into said rectangular holes.

As such, in the connector for memory cards according to the present invention, the first cantilever contacts for a short memory card (such as an SD card) and the second cantilever contacts for a long memory card (such as a Memory Stick card) are pressed into the housing in the same direction.

In such a connector for memory cards constructed such that the two kinds of contact terminal are pressed into the connector housing in the same direction, the workability in the assembly of the contact terminal is improved.

In the connector for memory cards according to the present invention, a plurality of first lead parts and a plurality of second lead parts extend out in parallel with a predetermined spacing in the rear part of the housing. Thus, these lead part groups can simultaneously be image-acquired with a CCD camera. This reduces the time necessary for inspecting the presence or absence of a lead bend.

In the connector for memory cards according to the present invention, two kinds of memory cards at least having a length different from that of the other card in the insertion direction can be inserted or extracted in the same direction. This ensures a degree of freedom in the design of an electronic device into which the connector for memory cards according to the present invention is built. Further, since the two kinds of contact terminal are pressed into the connector housing in the same direction, the workability in the assembly of the contact terminal is improved.

Further features of the present invention, its nature, and various advantages will be more apparent from the accompanying drawings and the following detailed description of the present invention.

DESCRIPTION OF THE PREFERRED EMBODIMENT

The preferred embodiment of the present invention will be described below in reference to the drawings. However, the present invention is not limited to the embodiment, and various modifications and changes in design can be made without departing from the scope of the present invention.

Figure 1A:
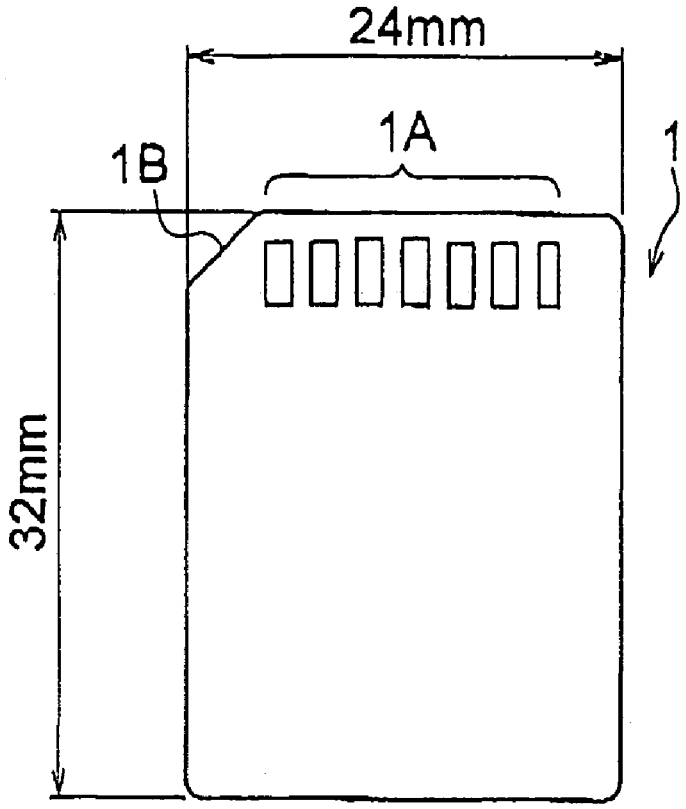
FIGS. 1A-1C are external views showing an SD card serving as a short memory card used in a connector for memory cards according to the present invention.
Figure 1C:
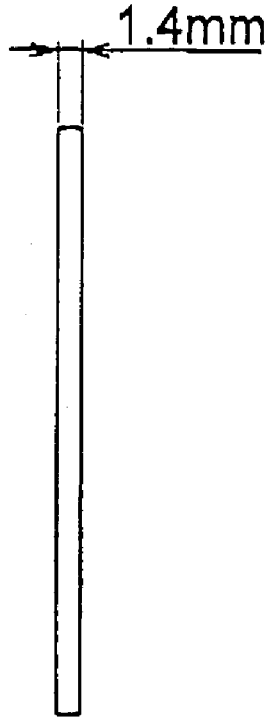
Figure 1B:
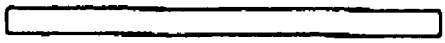

FIGS. 1A-1C are external views showing an SD card 1 in a connector for memory cards according to the present invention. FIG. 1A is a plan view of the SD card 1. FIG. 1B is a front view of FIG. 1A. FIG. 1C is a side view of FIG. 1A.

As shown in the embodiment of FIGS. 1A-1C, an end part of the SD card 1 is provided with seven poles of surface contact terminal 1A. On the surface contact terminal 1A side, a cut 1B is formed in the shape of a right triangle so that the SD card 1 is prevented from being inserted incorrectly. The outer dimensions of the SD card 1 are 24 mm×32 mm. Its thickness is 1.4 mm. The SD card 1 is referred to as a short memory card in the this specification.

Figure 2A:
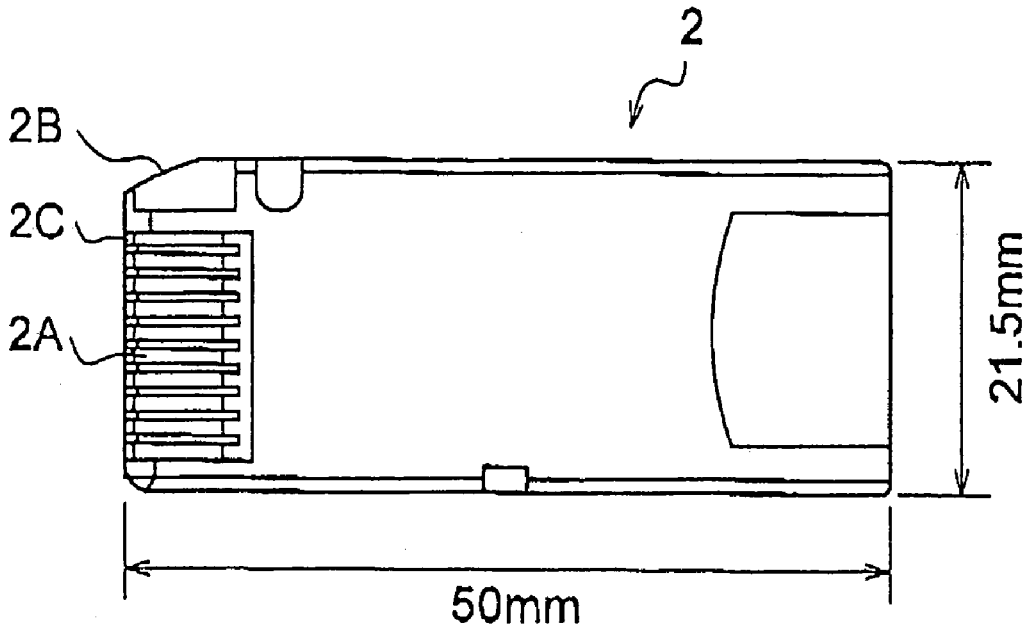
FIGS. 2A and 2B are external views showing a Memory Stick card serving as a long memory card used in a connector for memory cards according to the present invention.
Figure 2B:
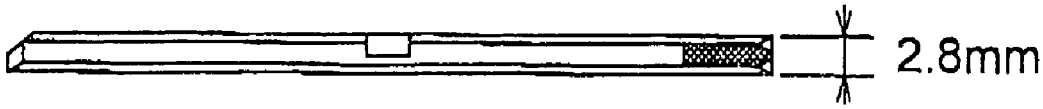

FIGS. 2A and 2B are external views of a Memory Stick card 2 used in the connector for memory cards according to the present invention, FIG. 2A is a plan view of the Memory Stick card 2, while FIG. 2B is a front view of FIG. 2A.

As shown in the embodiment in FIGS. 2A and 2B, a plurality of recesses 2C are formed on a leading end side of the Memory Stick card 2. Ten poles of surface contact terminal 2A are arranged on the bottom surface of each recess 2C. On the surface contact terminal 2A side, a cut 2B is formed in the shape of a right triangle such that the Memory Stick card 2 is prevented from being inserted incorrectly.

The outer dimensions of the Memory Stick card 2 are 21.5 mm×50 mm. Its thickness is 2.8 mm. The Memory Stick card 2 is referred to as a long memory card in this specification.

Figure 3:
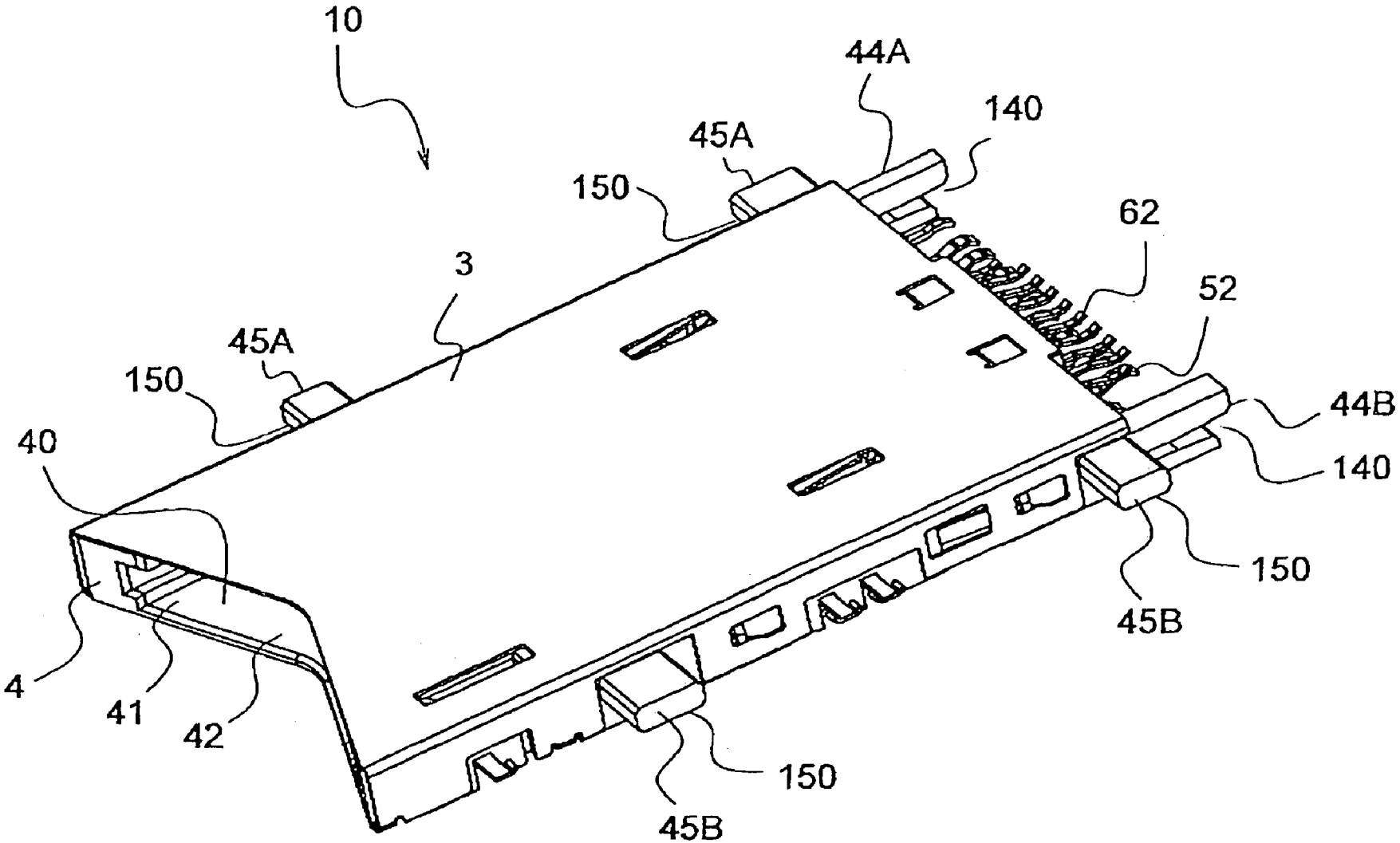
FIG. 3 is a perspective external view showing an embodiment of a connector for memory cards according to the present invention.

FIG. 3 is a perspective external view showing a connector for memory cards (a connector, hereafter) according to an embodiment of the present invention. In the connector 10 in FIG. 3, reference numeral 3 denotes a cover. Reference numeral 4 denotes a housing.

In the embodiment of FIG. 3, the cover 3 is formed by folding at right angles the right and left sides of a thin metal plate. The housing 4 is formed of an insulating synthetic resin material and in the shape of an approximately thin rectangular parallelepiped. An upper surface opening recess 40 is formed in the housing 4.

In the embodiment of FIG. 3, when the cover 3 covers the upper surface opening recess 40, a card holding part 42 is formed in the shape of an approximately thin rectangular parallelepiped and has a housing space having a card insertion port 41 through which the SD card 1 (referring to FIG. 1) and the Memory Stick card 2 (referring to FIG. 2) may be inserted in common.

In the embodiment of FIG. 3, a plurality of cantilever contacts 5 (described later) for contacting with surface contact terminal 1A (referring to FIG. 1) on the SD card 1 are arranged opposite to the card insertion port 41 in the housing 4. The plurality of cantilever contacts 5 comprise first lead parts 52 extending from a side surface opposite to the card insertion port 41 and soldered to a printed circuit board 20 as described later.

In the embodiment in FIG. 3, a plurality of cantilever contacts 6 (described later) for contacting with surface contact terminal 2A (referring to FIG. 2) on the Memory Stick card 2 are arranged opposite to the card insertion port 41 in the housing 4. The plurality of cantilever contacts 6 comprise second lead parts 62 extending from the side surface opposite to the card insertion port 41 and soldered to the printed circuit board 20 as described later.

In the embodiment in FIG. 3, these first lead parts 52 and second lead parts 62 are distorted and bent such that a leading end portion thereof is easily receiving the printed circuit board 20 as described later. The respective bent parts are arranged opposite to each other with a predetermined distance such that the bent parts may contact with both respective surfaces of the printed circuit board 20.

In the embodiment in FIG. 3, a pair of first protrusions 44A and 44B protrude from a side surface on an inner side opposite to the card insertion port 41. Each of the pair of first protrusions 44A and 44B is provided with a recess 140 for gripping both surfaces of the printed circuit board 20 as described later. The recess 140 is formed so as to align with a predetermined gap between the two opposing pairs of the first lead parts 52 and the second lead parts 62. The pair of first protrusions 44A and 44B are arranged at both end positions of a plurality of the first lead parts 52 and a plurality of the second lead parts 62 aligned in a line.

Further, as shown in FIG. 3, a plurality of second protrusions 45A and 45B protrude in opposite directions to each other from two mutually opposing side surfaces adjacent to the side surface opposite to the card insertion port 41. The plurality of second protrusions 45A and 45B have supporting surfaces 150 for abutting on a front surface of the printed circuit board 20 as described later.

Figure 4A:
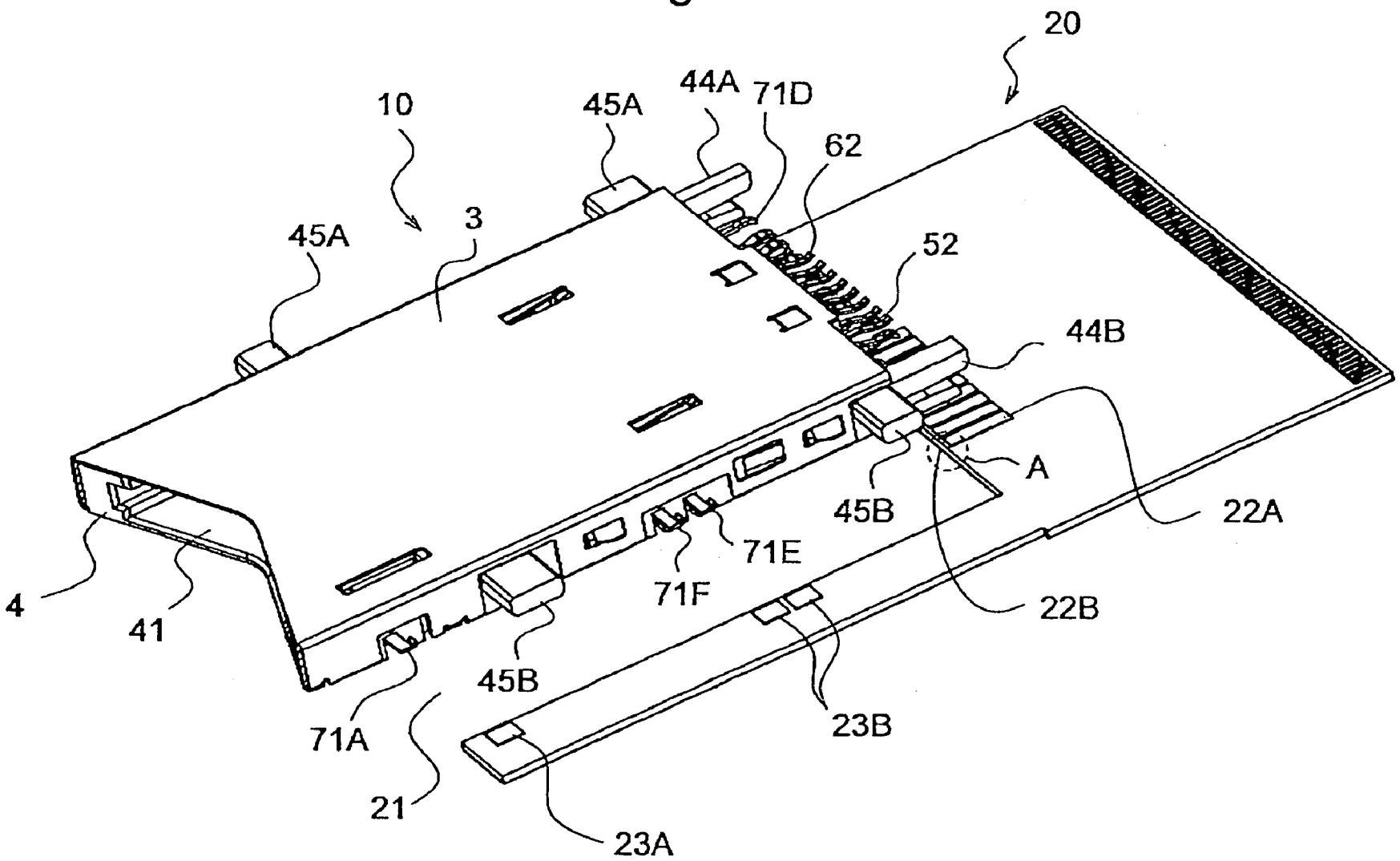
FIGS. 4A and 4B are perspective external views showing a connector for memory cards and a printed circuit board into which the connector for memory cards is built according to the present invention.

FIG. 4A is a perspective external view of a connector 10 and a printed circuit board 20 on which the connector 10 is surface-mounted according to the present invention.

As shown in the embodiment in FIG. 4A, the printed circuit board 20 is provided with a rectangular slot 21. The connector 10 is assembled on the printed circuit board 20 in such a manner that the slot 21 abuts on the side surface on the inner side opposite to the card insertion port 41 on the front side as well as on both of the right and left opposing side surfaces adjacent to the side surface opposite to the card insertion port 41.

Figure 4B:
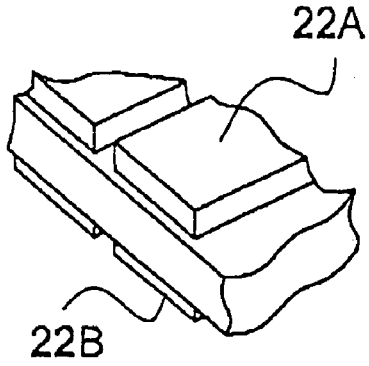

Further, edge connectors 22A and 22B are formed in edge portions on both surfaces of the rectangular slot 21. In FIG. 4A, the edge connectors 22B are behind the edge connectors 22A, and are not clearly shown. However, the connectors are clearly seen in the partial enlarged view in FIG. 4B.

In the embodiment of FIG. 4A, the edge connectors 22A and 22B formed on both surfaces of the printed circuit board 20 are inserted between the first lead parts 52 and the second lead parts 62 arranged oppositely, The second lead parts 62 on the top side are soldered to the edge connectors 22A on the front side (front surface). The first lead parts 52 on the bottom side are soldered to the edge connectors 22B on the back side (back surface).

Figure 5:
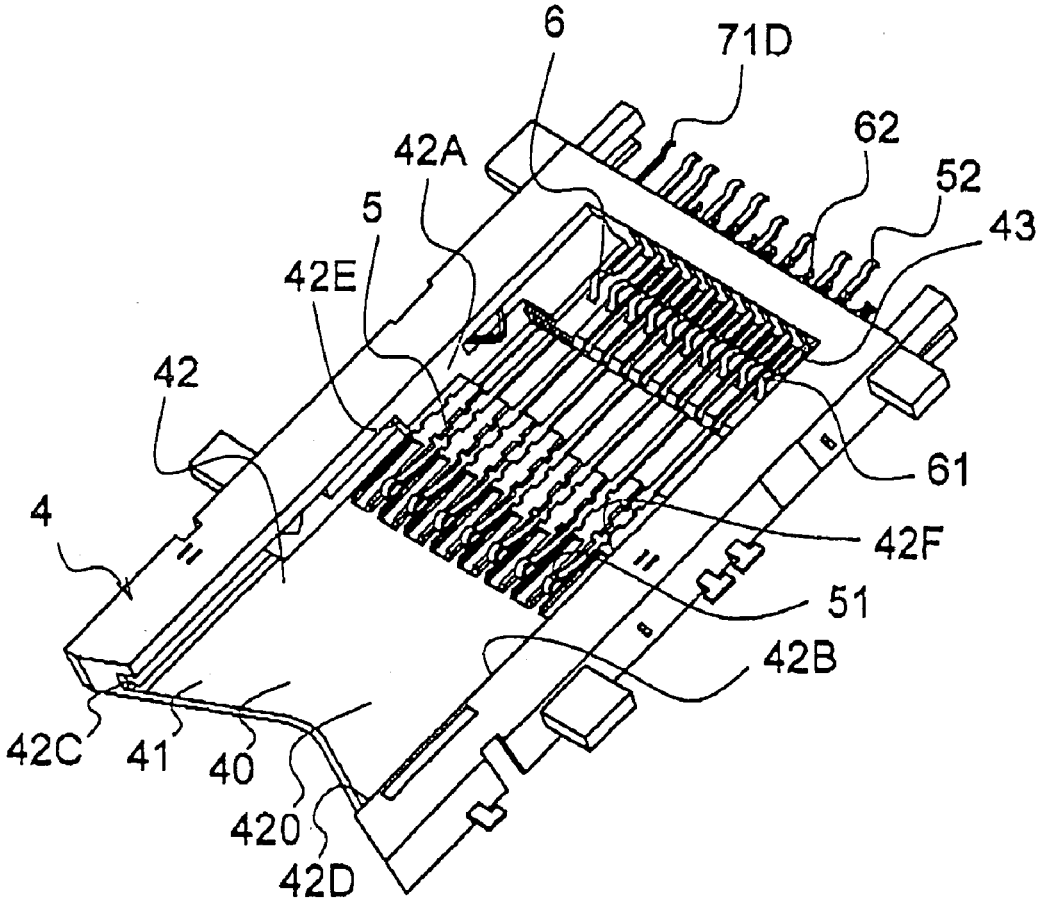
FIG. 5 is a perspective external view showing a connector for memory cards shown in FIG. 3 in a state where a cover is removed according to the present invention.

FIG. 5 is a perspective external view of the connector 10 in a state where the cover 3 shown in FIG. 3 is removed. As shown in the embodiment of FIG. 5, a pair of grooves 42C and 42D for guiding the mutually opposing side surfaces of the SD card 1 (referring to FIG. 1) inserted through the card insertion port 41 are formed in a pair of mutually opposing inner walls 42A and 42B of the card holding part 42.

The mutually opposing grooves 42C and 42D are disposed with a distance slightly larger than the width of the SD card 1 (referring to FIG. 1). The SD card 1 is guided with the width constrained by these grooves 42C and 42D so that the surface contact terminals 1A (referring to FIG. 1) of the SD card 1 may be positioned as aligned with a plurality of the cantilever contacts 5, A pair of the grooves 42C and 42D are provided with stopping edges 42E and 42F, respectively, so that the surface contact terminals 1A of the SD card 1 are stopped at a near position from the card insertion port 41.

As shown in FIG. 5, the cantilever contacts 5 are composed of plate spring contacts. The function of the plate springs allows the cantilevers to serve as contacts. A plurality of these cantilever contacts 5 are side by side aligned in a line perpendicular to the insertion direction of the SD card 1 (referring to FIG. 1), and parallel with the width direction of the SD card.

On the other hand, as shown in the embodiment of FIG. 5, the mutually opposing side surfaces of the Memory Stick card 2 (referring to FIG. 2) to be inserted through the card insertion port 41 are guided by a pair of the mutually opposing inner walls 42A and 42B of the card holding part 42.

The pair of mutually opposing inner walls 42A and 42B are disposed with a distance slightly larger than the width of the Memory Stick card 2 (referring to FIG. 2). Thus, the Memory Stick card 2 is guided with the width constrained by these inner walls 42A and 42B so that the surface contact terminals 2A (referring to FIG. 2) of the Memory Stick card 2 may be positioned as aligned with a plurality of the cantilever contacts 6.

When the Memory Stick card 2 abuts on a stopper 43 opposite to the card insertion port 41, the surface contact terminals 2A of the Memory Stick card 2 are stopped at a far position from the card insertion port 41.

As shown in FIG. 5, the cantilever contacts 6 are composed of plate spring contacts. The function of the plate springs allows the cantilevers to serve as contacts. A plurality of these cantilever contacts 6 are side by side aligned in a line perpendicular to the insertion direction of the Memory Stick card 2 (referring to FIG. 2).

In the embodiment of FIG. 5, a plurality of the cantilever contacts 5 have first contact points 51 for contacting with the surface contact terminals 1A (referring to FIG. 1) of the SD card 1. The first contact points 51 of the plurality of cantilever contacts 5 are arranged in the card holding part 42. The first lead parts 52 to be soldered while having the first contact points 51 to the opposite end extend outside from the stopper 43 opposite to the card insertion port 41.

Further, in the embodiment of FIG. 5, the plurality of cantilever contacts 6 have second contact points 61 for contacting with the surface contact terminals 2A (referring to FIG. 2) of the Memory Stick card 2. The second contact points 61 of the plurality of cantilever contacts 6 are arranged in the card holding part 42. The second lead parts 62 to be soldered while having the second contact points 61 to the opposite end extend outside from the stopper 43 opposite to the card insertion port.

In the embodiment of FIG. 5, the plurality of cantilever contacts 5 and the plurality of cantilever contacts 6 are arranged in parallel to each other in the housing 4. Further, the plurality of first lead parts 52 and the plurality of second lead parts 62 extend outside in parallel to each other from the stopper 43. Further, the plurality of first lead parts 52 and the plurality of second lead parts 62 are arranged opposite to each other with a predetermined space.

Figure 6D:
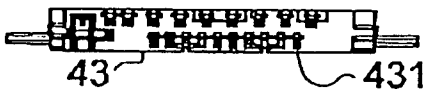
FIGS. 6A-6E are configuration diagrams showing a connector for memory cards shown in FIG. 5 in a state where a cover is removed according to the present invention.
Figure 6A:
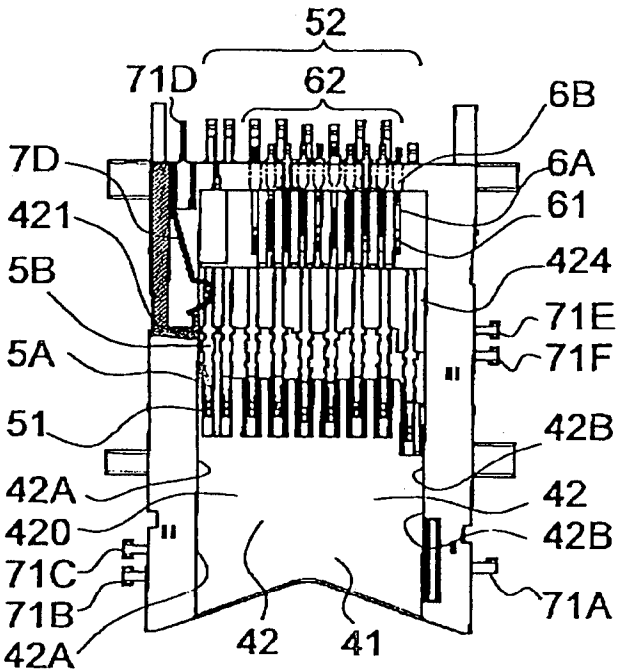
Figure 6C:
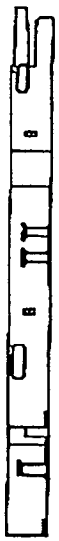
Figure 6E:
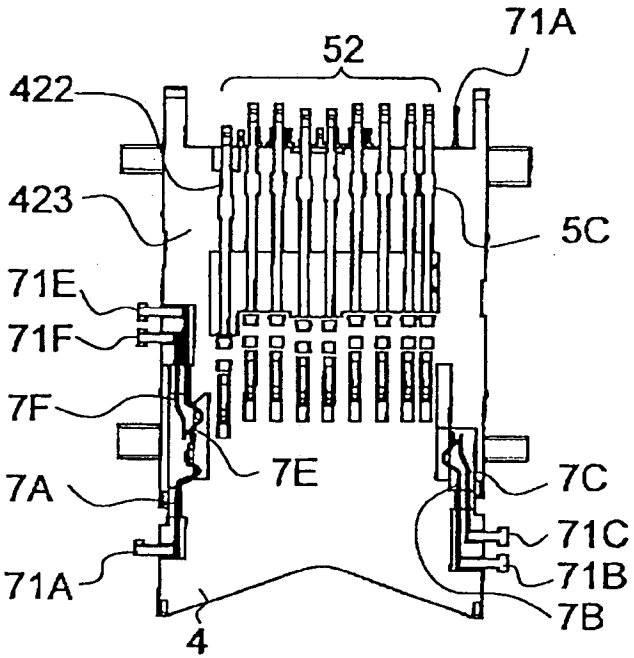
Figure 6B:
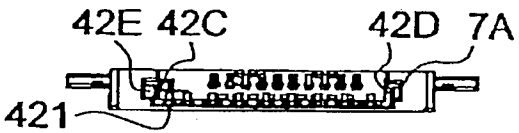

The configuration of the connector 10 is described below in further detail with reference to FIGS. 6A-6E. FIG. 6A is a plan view of the connector 10 shown in FIG. 5 in a state where the cover 3 is removed. A part of this figure is shown as a cross section. FIG. 6B is a front view of FIG. 6A. FIG. 6C is a right-hand side view of FIG. 6A. FIG. 6D is a rear view of FIG. 6A. FIG. 6E is a bottom view of FIG. 6A.

As shown most clearly in FIG. 6A, a plurality of first rectangular grooves 421 for holding first fixing parts 5B in the vicinity of first free end parts 5A having the first contact points 51 are formed in the bottom surface 420 of the card holding part 42.

Further, as shown most clearly in FIG. 6E, a plurality of second rectangular grooves 422 for holding second fixing parts 5C in the vicinity of first lead parts 52 are formed in the bottom surface 423 of the housing 4 opposite to the bottom surface 420 of the card holding part 42.

In the embodiment of FIGS. 6A-E, through holes 424 for separating the plurality of first rectangular grooves 421 and the plurality of second rectangular grooves 422 are formed in the bottom surface 420 of the card holding part 42. The first free end parts 5A of the cantilever contacts 5 are inserted into the through holes 424. Then, the first fixing parts 5B and the second fixing parts 5C are cooperatively pressed into the first rectangular grooves 421 and the second rectangular groove 422.

On the other hand, in the embodiment of FIG. 6, a plurality of rectangular holes 431 for holding third fixing parts 6B continuing to second free end parts 6A having second contact points 61 are formed in the stopper 43. The plurality of rectangular holes 431 pass through toward the card insertion port 41. The second free end parts 6A of the cantilever contacts 6 are inserted into the rectangular holes 431 toward the card insertion port 41. Then, the third fixing parts 6B are pressed into the rectangular holes 431.

In the embodiment of FIGS. 6A-E, as shown most clearly in FIG. 6E, a plate spring 7A is arranged on the groove 42D side in the housing 4. A free end of the plate spring 7A protrudes from the groove 42D. The plate spring 7A biases toward the groove 42C a side surface of the SD card 1 (referring to FIG. 1) inserted into the pair of grooves 42C and 42D.

In the plate spring 7A, a lead part 71A to be soldered extends outside from housing 4. The bottom surface of the lead part 71A is soldered to a pad 23A of the printed circuit board 20 shown in FIG. 4A.

Further, as shown most clearly in FIG. 6E, a movable spring plate 7B and a fixed plate 7C are arranged in the groove 42C of the housing 4. When an SD card 1 (referring to FIG. 1) is inserted, the movable spring plate 7B and the fixed plate 7C serve as a detection switch such that respective end portions thereof contact with each other.

In the movable spring plate 7B and the fixed plate 7C, lead parts 71B and 71C to be soldered extend outside from the housing 4. The bottom surfaces of the lead parts 71B and 71C are soldered to pads (not shown) on the printed circuit board 20 shown in FIG. 4A.

In the embodiment of FIGS. 6A-E, as shown most clearly in FIG. 6A, a plate spring 7D is arranged on the inner wall 42A side in the housing 4. A free end of the plate spring 7D sticks out from the inner wall 42A. The plate spring 7D biases toward the inner wall 42B a side surface of the Memory Stick card 2 (referring to FIG. 2) guided by the pair of inner walls 42A and 42B.

In the plate spring 7D, a lead part 71D to be soldered extends outside from the housing 4. The lead part 71D is soldered to an edge connector 22B formed on the printed circuit board 20 as shown in FIG. 4A.

Further, as shown most clearly in FIG. 6E, a movable spring plate 7E and a fixed plate 7F are arranged on the inner wall 42B side in the housing 4, When a Memory Stick card 2 (referring to FIG. 2) is inserted, the movable spring plate 7E and the fixed plate 7F serve as a detection switch such that respective end portions thereof contact with each other.

In the movable spring plate 7E and the fixed plate 7F, lead parts 71E and 71F to be soldered extend outside from the housing 4. The bottom surfaces of the lead parts 71E and 71F are soldered to pads 23B of the printed circuit board 20 shown in FIG. 4A.

The operation of the connector according to the present invention is described below.

FIG. 7 is a longitudinal cross section showing the connector 10 shown in FIG. 6 and illustrating the change in the processes of assembling the cantilever contacts 5 and 6 into the housing 4.

Figure 7A:
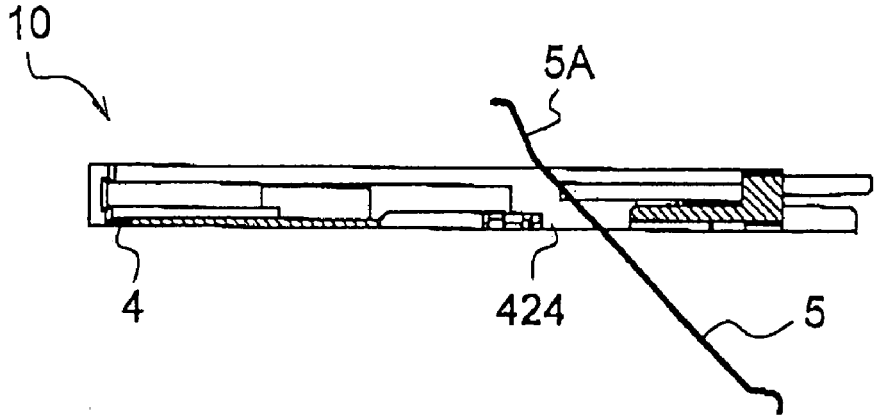
FIGS. 7A-7C are longitudinal cross sectional views showing a connector for memory cards shown in FIG. 6, and illustrating the change in the processes of assembly of two kinds of cantilever contacts into a housing.

In FIG. 7A, the cantilever contacts 5 led by their first free end parts 5A are inserted into the through holes 424 formed in the housing 4. Then, the cantilever contacts 5 are turned counter clockwise such that the cantilever contacts 5 are held in parallel to the bottom surface 420 of the card holding part 42 as shown in FIG. 5. This state is shown in FIG. 7B.

Figure 7B:
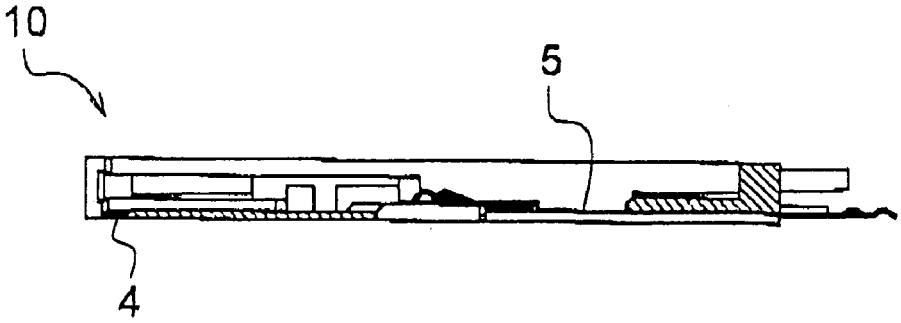
Figure 7C:
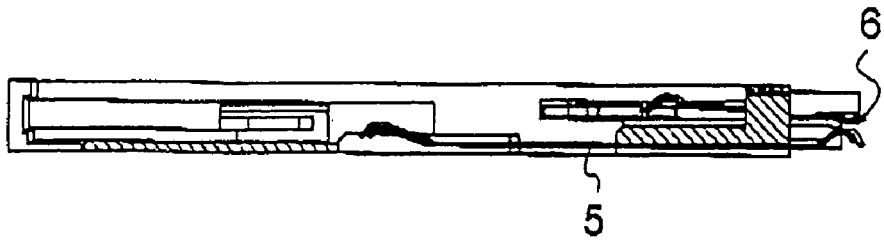
Figure 8:
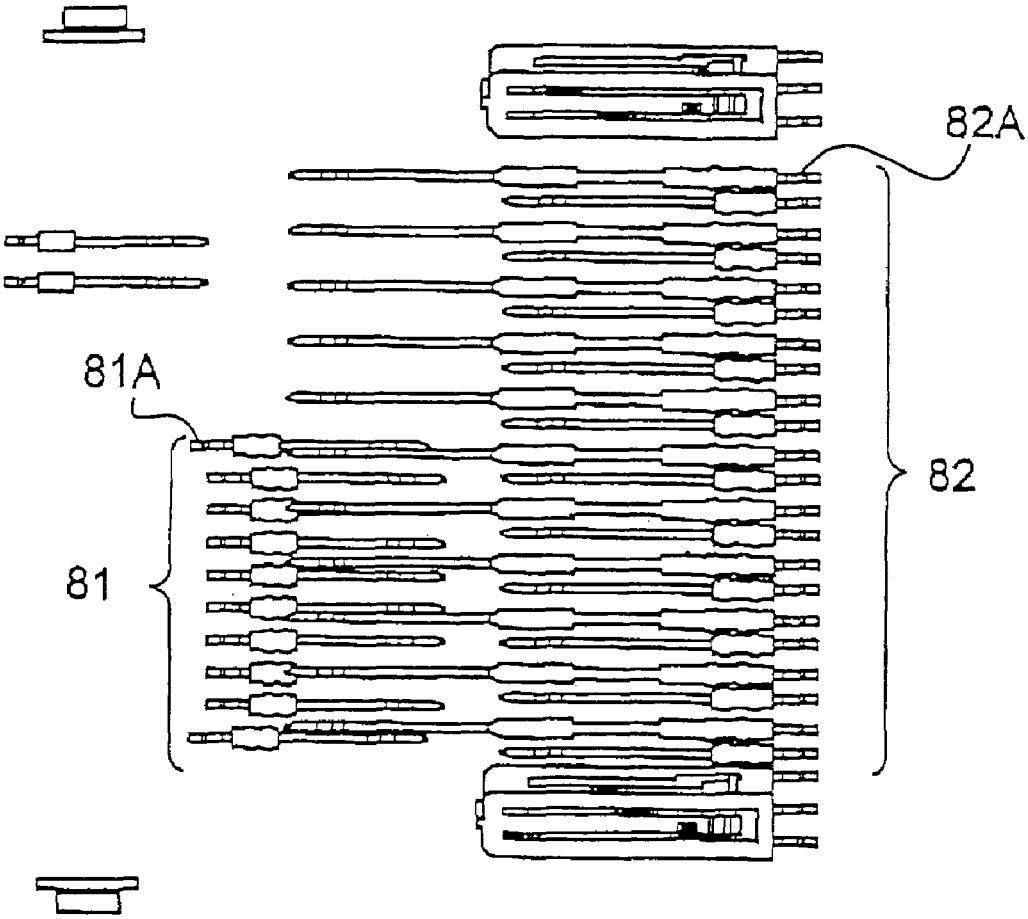
Fig. 8 PRIOR ART
FIG. 8 is a plan view showing the arrangement of contact terminal for both memory cards according to Japanese Published Unexamined Patent Application No. 2001-313107. This drawing corresponds to FIG. 9 of Japanese Published Unexamined Patent Publication No. 2001-313107.
Figure 9:
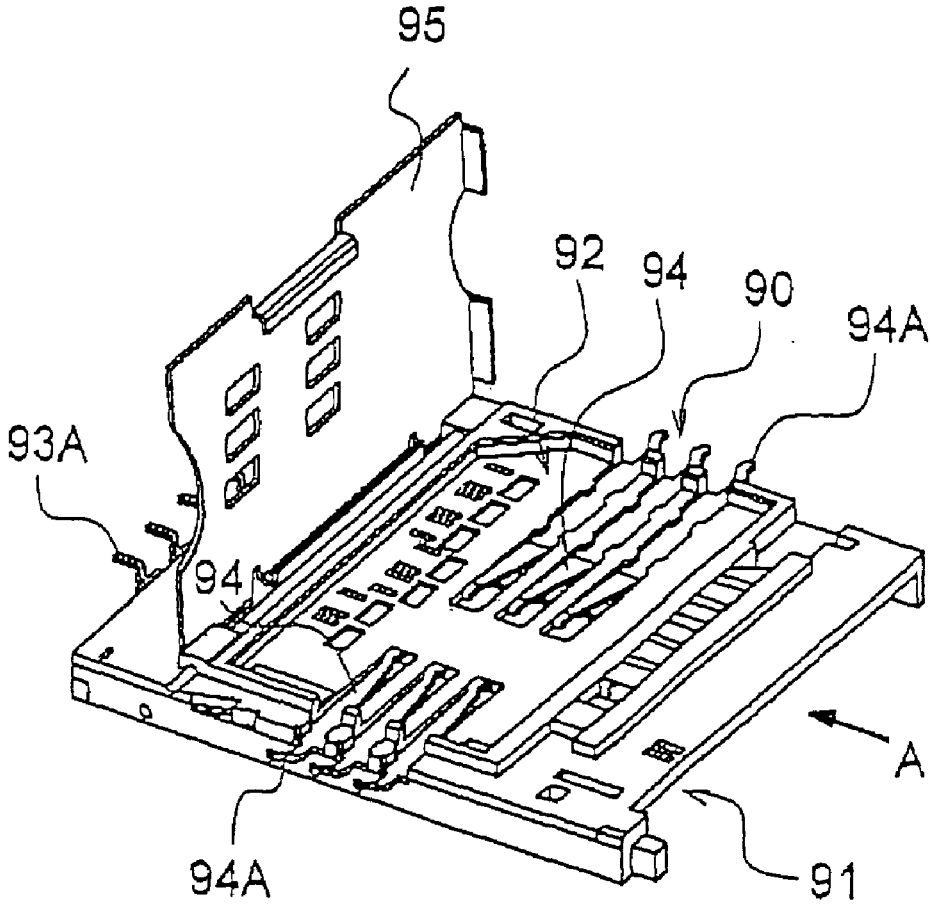
Fig. 9 PRIOR ART
FIG. 9 is a perspective view showing a connector for memory cards according to an embodiment of Japanese Published Unexamined Patent Publication No. 2002-134234 in a state where an opening/closing cover is open. This drawing corresponds to FIG. 1 of Japanese Published Unexamined Patent Publication No. 2002-134234.

After the state of FIG. 7B, when the cantilever contacts 5 are moved left, the first fixing parts 5B and the second fixing parts 5C are at the same time pressed into the first rectangular grooves 421 and the second rectangular grooves 422, as shown in FIG. 6. As a result, assembly of the cantilever contacts 5 is completed as shown in FIG. 7C.

On the other hand, as shown in FIG. 6, the second free end parts 6A of the cantilever contacts 6 are inserted into the rectangular holes 431 toward the card insertion port 41. Then, the third fixing parts 6B are pressed into the rectangular holes. As a result, assembly of the cantilever contacts 6 is completed as shown in FIG. 7C.

As such, in a connector according to the present invention, two kinds of cantilever contacts are pressed into a housing in the same direction. This may improve the workability in the assembly of the cantilever contacts serving as contact terminal.

Further, in a connector according to the present invention, at least two kinds of memory cards having different lengths in the insertion direction can be inserted or extracted through the same card insertion port as shown in FIG. 3. This ensures a degree of freedom in the design of an electronic device into which the connector according to the present invention is built.

Furthermore, in a connector according to the present invention, a plurality of first lead parts and a plurality of second lead parts extend outside in parallel with a predetermined spacing in the rear part of a housing as shown in FIGS. 3 to 6. Thus, two groups of the lead parts can simultaneously be inspected in an image acquired by a CCD camera. This reduces the time necessary for inspecting the existence of a bent lead.

What is claimed is:

1. A connector for memory cards of differing lengths in an insertion direction, comprising:

a housing comprising:

a card insertion port through which one of the memory cards is inserted;

a card holding part having a housing space in which the memory card is held; and a stopper for stopping a memory card of longer length disposed opposite to the card insertion port;

a first cantilever contact comprising:

a first contact point in the housing space for contacting a surface contact terminal of a memory card of shorter length; and a first lead part extending outside of the housing from the stopper, along the insertion direction; and a second cantilever contact comprising: a second contact point in the housing space for contacting a surface contact terminal of the memory card of longer length; and a second lead part extending outside of the housing from the stopper along the insertion direction;

wherein the first cantilever contact and the second cantilever contact are disposed apart from each other with a predetermined distance such that the first lead part and the second lead part are arranged opposite to each other with a predetermined gap therebetween.

2. The connector according to claim 1, wherein the second cantilever contact further comprises a second free end part having the second contact point thereon and a third fixing part contiguous to the second free end part, the housing further comprises a plurality of rectangular holes for holding the third fixing part formed in the stopper, the rectangular holes pass thorough the stopper and communicate with the housing space, and wherein, the second free end part is inserted to pass thorough each of the rectangular holes so that the third fixing part is pressed into each of the rectangular holes.

3. The connector according to claim 1, wherein the short memory card includes a secure digital card.

4. The connector according to claim 1, wherein the long memory card includes a memory stick card.

5. The connector according to claim 1, comprising:

another first cantilever contact being disposed laterally to the first cantilever contact so as to form a group of the first cantilever contacts; and another second cantilever contact being disposed laterally to the second cantilever contact so as to form a group of the second cantilever contacts, wherein the group of the first cantilever contacts and the group of the second cantilever contacts are disposed such that the groups are arranged substantially in parallel with each other.

6. The connector according to claim 5, wherein the card holding part comprises opposing inner walls defining the housing space; and grooves being formed in the respective inner walls, the grooves guiding the short memory card with lateral side surfaces thereof constrained by the grooves.

7. The connector according to claim 1, wherein the card holding part comprises opposing inner walls defining the housing space; and grooves being formed in the respective inner walls, the grooves guiding the short memory card with lateral side surfaces thereof constrained by the grooves.

8. The connector according to claim 7, wherein each of the grooves comprises a stopping edge for stopping the memory card of shorter length.

9. The connector according to claim 1, wherein the first cantilever contact further comprises a first free end part having the first contact point thereon, a first fixing part adjacent to the first free end part, and a second fixing part adjacent to the first lead part, the housing further comprises a plurality of first rectangular grooves for holding the first fixing part, a plurality of second rectangular grooves for holding the second fixing parts, and thorough holes, the first rectangular grooves are formed in a surface of a bottom of the card holding part, the second rectangular grooves are formed in an opposing surface of the bottom of the card holding part, and the thorough holes are formed between the first rectangular grooves and the second rectangular grooves; and wherein each of the first cantilever contacts passes thorough each of the thorough holes so that the first fixing part is pressed into each of the first rectangular grooves and the second fixing part is pressed into each of the second rectangular grooves.

10. The connector according to claim 9, wherein the second cantilever contact further comprises a second free end part having the second contact point thereon and a third fixing part contiguous to the second free end part, the housing further comprises a plurality of rectangular holes for holding the third fixing part formed in the stopper, the rectangular holes pass thorough the stopper and communicate with the housing space, and wherein, the second free end part is inserted to pass thorough each of the rectangular holes so that the third fixing part is pressed into each of the rectangular holes.

* * * * *